United States Patent [19]

Veverka et al.

[11] Patent Number: 4,970,619

[45] Date of Patent: Nov. 13, 1990

[54] ELECTRICAL FAULT PROTECTIVE DEVICE

[75] Inventors: Edward F. Veverka; Gary L. Goedde, both of Racine, Wis.

[73] Assignee: Cooper Industries, Inc., Houston, Tex.

[21] Appl. No.: 395,597

[22] Filed: Aug. 18, 1989

[51] Int. Cl.[5] ..... H01H 39/00

[52] U.S. Cl. ..... 361/15; 361/104; 337/203; 337/214; 337/250; 337/282

[58] Field of Search ..... 361/15, 104, 117, 124, 361/272, 274, 275; 337/28, 29, 30, 31, 34, 202, 213, 214, 250, 282

[56] References Cited

U.S. PATENT DOCUMENTS

| | | | |
|---|---|---|---|
| 2,340,055 | 1/1944 | Halbrook | 200/133 |
| 3,575,683 | 4/1972 | Fahnoe | 337/282 |
| 3,710,212 | 1/1973 | Marek et al. | 337/30 X |
| 3,868,617 | 2/1975 | Dragon et al. | 337/203 |
| 4,503,414 | 3/1985 | Sykes et al. | 337/31 |
| 4,885,561 | 5/1989 | Veverka et al. | 337/190 |

OTHER PUBLICATIONS

McGraw-Edison Company Power Systems Apparatus Catalog, p. 5, dated Feb. 1978.

*Primary Examiner*—Derek S. Jennings
*Attorney, Agent, or Firm*—Wigman & Cohen

[57] ABSTRACT

An electrically conductive expulsion fuse manifold and bus for connecting and mounting a plurality of fuses which upon operation expel gases into the manifold is shown and described. The expulsion fuses are attached to the manifold by means of clamps, flanges, and/or threaded connections. Each expulsion fuse includes an expendable cap which may be blown off into the manifold under high magnitude capacitor discharge currents and/or fault currents for safe double-vented fuse operation. The manifold may also be non-conductive where electrical isolation is required and where a separate electrically conductive bus is employed.

41 Claims, 2 Drawing Sheets

FIG. 1
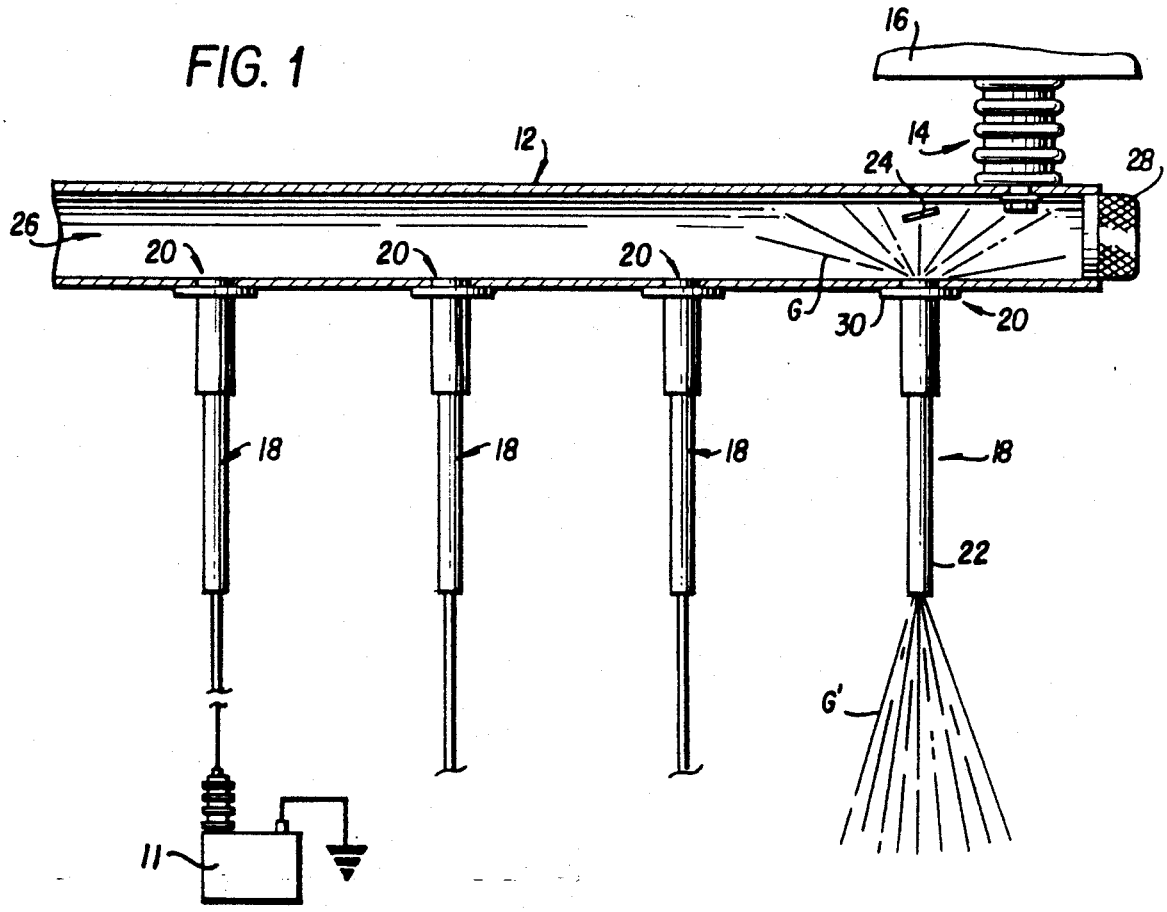
FIG. 2
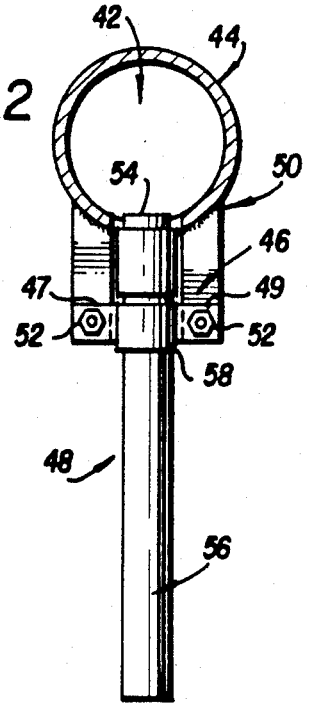
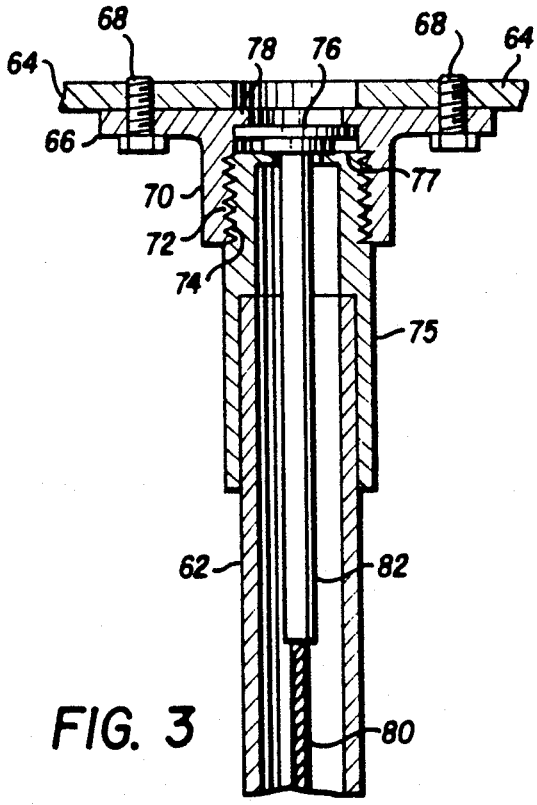
FIG. 3

ELECTRICAL FAULT PROTECTIVE DEVICE

BACKGROUND OF THE INVENTION

The present invention relates to electrical fault protective devices, and more particularly to exhaust control devices for expulsion-type fuses. The electrical fault protector of the invention is designed to protect power factor capacitor banks in power distribution systems where discharge of hot ionized gases and metallic materials from an expulsion fuse may damage the capacitors and cause internal bank flashover.

Expulsion fuses (also known as expulsion-fuse units) are vented fuse protection units having a body part and a fusible part or link and a leader, in which an overcurrent passing through the fusible element rapidly heats and melts the fusible element. The high current density opens the circuit (i.e., the fuse 'blows') and creates an arc. The expulsion effect of gases produced by the resulting arc on the lining of the fuse body rapidly discharges the fusible part (including combustion products) connected to the leader and extinguishes the arc. Expulsion fuses known in the prior art include single-ended and double-ended discharge types.

In the design of power factor correction capacitor banks, the present expulsion fuse art is limited to application on power systems with up to 6,000 amperes fault available. Expensive current limiting fuses are generally used on capacitor banks at fault currents above 6,000, but are quite costly. A need has thus developed to provide expulsion fuse protection in an economical and reliable way at interrupting ratings of up to 10,000 amperes and above. The prior art was unable to provide protection above 6,000 amperes with single-ended expulsion fuse designs. The expulsion discharge products and dynamic forces developed by single-ended fuses large enough to handle 10,000 amperes are known to damage capacitor block bus systems. Further, the capacitor bank discharge current known to occur when a capacitor fails in a large bank is sufficient to destroy the single-ended expulsion-type fuses. Also, the disintegrating fusible link and the hot ionized gases developed on high energy interruptions are blown into adjacent capacitors, causing internal capacitor block flashovers and resultant damage.

Double-ended expulsion-type fuses vent the fuse at both ends. Such a design achieves higher power—frequency fault protection and is capable of handling the capacitor bank discharge currents without damage.

U.S. Pat. No. 2,340,055 shows a protection device for telephone lines in which a chamber receives exhausted expulsion gases from a horizontal fuse bank located above the chamber. The expulsion gases are released from vent holes in the lower sides of the fuses through slots in a fuse supporting panel. The expulsion discharge occurs at the center of the fuses rather than at the ends of the fuses.

U.S Pat. Nos. 3,575,683 and 3,868,617 both show exhaust control muffler devices for use with a fuse. These devices are located axially from one end of the generally elongated fuse and are generally cylindrical in shape. They do not employ a common bus muffler configuration that provides for the successful operation of a plurality of fuses.

BRIEF SUMMARY OF THE INVENTION

The present invention incorporates a hollow tube as an exhaust control device to receive at least some of the expulsion discharge products from an expulsion fuse or fuses. The improved exhaust control for expulsion-type fuses according to one embodiment of the present invention includes a common expulsion fuse discharge manifold into which a plurality of fuse discharge paths are connected. The manifold may advantageously serve as an electrically conductive bus for a bank of fuses electrically connected to a capacitor bank used for power factor correction. The hollow tube or manifold permits the use of double-ended expulsion fuses, where previously only single-ended fuses could be used effectively. This is because the hollow tube serves as a manifold to receive the expulsion discharge products and safely contain and divert them without damaging adjacent capacitors, fuses or other equipment, and safely diverts these products from any personnel in the immediate vicinity when the fuse acts.

The hollow tube end of these double-ended fuses includes a cap, which may be an expendable cap, and which releasably seals that end of each of the fuses. Under certain fault conditions, the fuse will operate, and expulsion products will be driven from the fuse body. These fault conditions will vary greatly, being dependent on the fuse design and rated fuse parameters. Upon the occurrence of a fuse-operating fault, the expulsion products are discharged from the free end of the fuse. The expendable caps releasably seal the hollow tube ends of the fuses; the seal effectively functions to close the hollow tube discharge end of the double-ended fuse for faults at generally lower discharge energy values. However, the seals are designed to release and permit the expulsion discharge products to exit from the hollow tube end upon the occurrence of a higher energy level fault. That is, the expendable cap retains the hollow tube end closed during lower energy faults, yet is releasable during higher energy faults. Thus the fuse is permitted to discharge its expulsion products and the expendable cap into the hollow tube and the tube to safely contain the expulsion discharge products on the occurrence of these higher energy level faults.

Double-ended expulsion type fuses vent the fuse body at both ends when the fault energy is substantial enough to discharge the expendable cap. Under lower energy fault conditions the expendable cap remains intact and in place over one end of the fuse so that the expulsion arc products expel the fuse leader from the other end to properly clear the applied voltage potential and safely interrupt the fault current. Such a design achieves higher power normal fault protection and in the case of capacitor fusing, is also capable of effectively handling capacitor discharge currents without damage.

In operation, then, the present invention functions similarly to a normal single ended fuse for lower energy level faults, but the hollow tube permits the expulsion products resulting from a higher level fault to blow off the expendable cap and release at least a portion of the resulting hot ionizing gases safely into the hollow tube.

The hollow tubular manifold may be either non-conductive or may be electrically conductive and also serve as a bus connecting a plurality of fuses, whereby the exhaust gases and particulate matter discharged from the fuse are directed by the manifold away from the fuse and isolated from the associated electrical equipment.

The fuses may be mounted on flanges connected to the fuse cap or by a mating threaded connection in which the cap end of the fuse is joined directly to the manifold. The manifold may be circular, square, rectangular or other suitable cross-sectional shape.

Among the objects of this invention are to provide an improved expulsion fuse which can be used with very large capacitor banks with power fault current availability up to at least 10,000 amperes.

It is a further object of this invention to limit expulsion fuse exhaust gases and discharge materials from coming into contact with adjacent capacitors or other components which can be damaged by the discharge products and fuse forces, and which can also cause open fault arcing to adjacent capacitors and lines, or from harming personnel or wildlife.

Another object of this invention is to provide a common discharge manifold for a plurality of fuses.

Still another object of the invention is to provide for connection of one or more fuses to an electrically conductive manifold capable of serving as a bus wherein discharge gases emitted from the expulsion fuse are directed through a wall of the electrically conductive manifold bus when the fuse is blown.

It is another object of this invention to provide an expulsion fuse having an expendable cap located on the end of the fuse which extends into the manifold.

Yet another object of the invention is to provide a fuse which is attached to a manifold by a mounting flange.

Another object of this invention is the provision of a screen located on at least one open end of the tubular manifold non-conducting manifold.

In another embodiment of the invention, an expulsion fuse discharge manifold is formed of a hollow, non-conductive tubular member having an attached conducting bus connecting a plurality of fuse ends. Further to this embodiment, an electrically conductive hollow tube may be used at one end of a group of expulsion fuses to interconnect them and to receive the expulsion discharge products and another hollow tube may be used at the other end of the tube to receive expulsion discharge products from the other end of the fuses.

Application of the present invention provides for expanded use of double vented expulsion fuses with safe operation as required by capacitor banks having large magnitude high frequency discharge currents and high available fault currents from major power system feeders.

BRIEF DESCRIPTION OF THE DRAWINGS

The above and further objects, features and advantages of the present invention will become apparent to those skilled in the art from a consideration of the following detailed description of the preferred embodiment, taken in conjunction with the accompanying drawings in which:

FIG. 1 is a side elevation view partly in cross-section of an expulsion fuse discharge manifold and a plurality of expulsion fuses in accordance with the present invention;

FIG. 2 is a cross-sectional view showing a variation in a clamp type mounting of an expulsion fuse to a circular expulsion fuse discharge manifold in accordance with the invention;

FIG. 3 shows in cross-section another variation in the mounting of a flange mounted expulsion fuse attached to a circular expulsion fuse discharge manifold bus in accordance with the invention;

DETAILED DESCRIPTION OF THE PREFERRED EMBODIMENT

Figure 4:
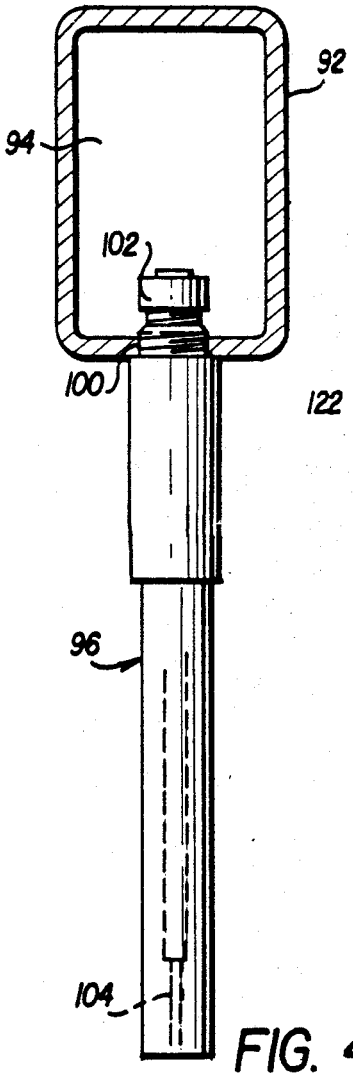
FIG. 4 shows another variation in the mounting of an expulsion fuse with a threaded collar mounted to an expulsion fuse discharge manifold in accordance with the invention in which the tubular manifold bus is rectangular in cross-section.

The present invention is illustrated in FIG. 1 through 7. FIG. 1 shows a cross-section of a tubular discharge manifold 12 which also functions as an interconnecting electrical bus in accordance with one aspect of the present invention. An insulator 14 supports the discharge manifold bus 12 from a mounting surface 16. A plurality of expulsion fuses 18 (which may be double-ended expulsion fuses according to the present invention) are shown mounted to the discharge manifold and bus 12 with respective flanged fuse mounting tube receiving portions 20 and electrically connected to a capacitor 11 to form an electrical fault protective device for use in a circuit with a capacitor bank. To demonstrate operation, the right-hand fuse 22 illustrates a feature of the invention in which a double vented expulsion fuse 22 is incorporated. Here, the gases and fuse material G′ are discharged from one end of the fuse 22 under certain lower energy fault conditions, and the gases and fuse material G and G′ are discharged from both ends of fuse 22 under higher energy value fault conditions. The values at which the fuse 22 expulses from only a single end G, and the values at which the fuse 22 expulses from both ends G and G′ are primarily dependent on the fuse design parameters and operation values.

An expendable cap 24 covering the mounting surface end of fuse 22 is dischargeable into the discharge manifold chamber 26 along with the hot gaseous products of the blown fusible part or link. A screened vent 28 which may be opened or removed for maintenance may be provided at the end of the discharge manifold to prevent contamination of the chamber 26 by bugs, small rodents, and/or other undesirable foreign matter which might otherwise enter the discharge manifold 12. The flanged fuse tube receiving portion may be joined to the manifold with fasteners, such as a threaded fastener or rivet which passes through a flange plate 30 and into the discharge manifold and bus 12.

In the embodiment illustrated in FIG. 2, the wall of a tubular chamber 42 forms a discharge manifold and bus 44 which uses a clamp 46 to attach a plurality of expulsion fuses 48 thereto. Clamp 46 suspends the fuses 48 from the manifold and bus 44 and is fastened as by welding to the discharge manifold and bus 44 at a location indicated at 50. The expulsion fuse 48 includes a tube 56 with a pair of arms 47, 49 and is fastened to the clamp 46 by fasteners 52, such as nuts and bolts or the equivalent. An expendable fuse cap 54 is provided for the intended double vent operation. In this embodiment, the fuse 48 may be exchanged by removing the fasteners 52 and extracting the expulsion fuse tube 56 with the arms 47, 49 attached thereto. This arrangement does not require opening up of the tubular discharge manifold and bus 44 for purposes of fuse replacement. Access through the tubular discharge manifold and bus 44 is not required.

FIG. 3 illustrates another embodiment of the present invention in which an expulsion fuse tube 62 is connected to a tubular discharge manifold and bus 64 (portions of which are omitted). A mounting flange 66 is attached to the tubular discharge manifold and bus 64 by fasteners 68 which may be threaded fasteners such as bolts. The flange 66 may also be attached to the manifold and bus 64 by welding, staking, riveting, or the like. A tubular fuse-receiving portion 70 having an internally threaded portion 72 mates with an external thread 74 end portion or fuse upper collar 75 secured to one end of the expulsion fuse tube 62. An expendable cap 76 is disposed at the manifold end of the fuse tube 62 and held in place against an annular shoulder 78 of the tubular fuse-receiving portion 70 by the end portion 74 of expulsion fuse tube 62 when the tube is threaded into the tubular fuse-receiving portion 70. A fuse collar shoulder 77 may be included to separate the components. The cap 76 is replaceable and may be made of a metal or any other suitable material which will provide successful expulsion fuse venting. A fuse link 80 is placed inside the fuse link tube 82 of expulsion fuse tube 62, and it is this fuse link 80 which provides the fusing action and power circuit interruption when excess current is passed through the device. Fuse link 80 is connected to the capacitor bank external of the fuse proper.

FIG. 4 shows a tubular discharge manifold and bus 92 of rectangular cross-section which has an expulsion chamber 94 and an expulsion fuse tube 96. In this embodiment, the upper end of the fuse tube 96 is mounted to the rectangular discharge manifold and bus 92 by a threaded connection 100 between the fuse tube 96 and the rectangular discharge manifold and bus 92. An expendable cap 102, which is replaceable, is held in place on the upper end of the expulsion fuse tube 96 (within chamber 94) by threads. Fuse link 104 is connected to the capacitor bank external of the fuse.

Figure 5:
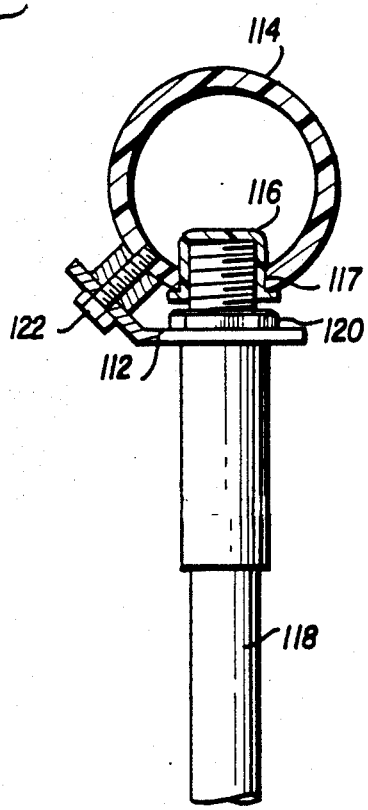
FIG. 5 is a cross-sectional view of an expulsion fuse discharge manifold according to the invention in which the expulsion fuse tubular discharge manifold is non-conductive, and wherein a separate capacitor bank bus is used to connect the fuse ends.

In FIG. 5 there is shown a further embodiment of the invention in which a bus 112 for a capacitor bank is separate from the manifold. The manifold 114 in this case may be tubular or of other cross-section, and may be made of any suitable material whether electrically conductive or not, including plastic or aluminum pipe, because the manifold functions primarily to control the expulsion products of the fuse rather than as an electrical bus. Bus 112 should, of course, be electrically conductive.

An expendable cap 116, which may be made of a metal or plastic material, is shown threaded on the fuse tube assembly and inserted into aperture 117 in the tubular exhaust manifold 114. The expulsion fuse tube 118 is fixed to bus 112 at location 120 by a nut threadably received on the body of the expulsion fuse, or by a flange, thread connection between the bus and fuse. A fastener 122, such as a bolt and nut, connects the bus 112 to the tubular exhaust manifold 114. For fuse link replacement, the fuse tube assembly is removed by loosening and moving nut 120.

Figure 6:
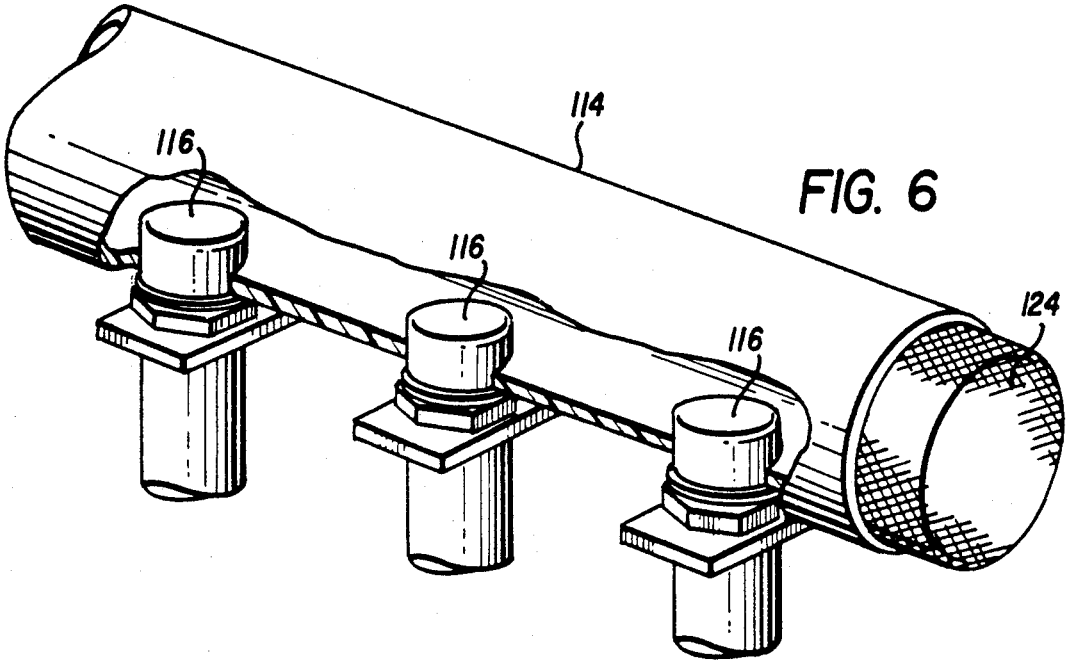
FIG. 6 is a cross-sectional view of the expulsion fuse discharge manifold of FIG. 5.

In FIG. 6 there is shown in cross-section a plurality of fuses mounted to the manifold 114 of FIG. 5. A plurality of expendable blow caps 116 are shown on the interior of the manifold 114, and a vent screen 124 is shown attached at one end of the manifold. Vent screen 124 is used to prevent contamination from dirt or pests. Vent screen 124, however, will permit gases to freely pass therethrough.

Figure 7:
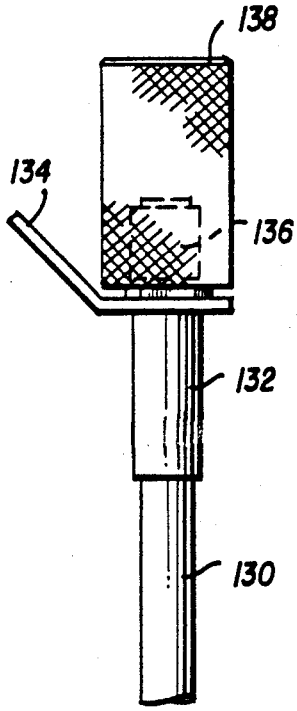
FIG. 7 is an elevation view partly in cross-section of an expulsion fuse screw mounted to a capacitor bus with an individual deionization gas deflector at the upper end of the fuse.

FIG. 7 of the drawings shows a power factor capacitor bank protective fuse arrangement in which expulsion occurs at one or both ends of the fuse. Measures are taken to control the expulsion exhaust gases as will be described hereinafter. The fuse includes an individual muffler which provides for deflection and cooling of the hot expulsion exhaust gases at a discharge end of the fuse, as well as for retention of an expendable fuse cap. This device requires the removal of the gas deflector muffler after each fuse operation for replacement of the expendable cap.

The gas deionizer/deflector of FIG. 7 may be used with an expulsion-type fuse in combination with a capacitor bank. The expulsion fuse 130 extends into a metal electrode 132 which is fixed with a threaded nut to a capacitor bank interconnecting bus 134. An expendable cap 136 on an expulsion fuse 130 is provided and is contained inside the deionizing muffler 138. The muffler is attached to the bus by screws which are not shown. When the expendable cap 136 is blown away by the force of the discharge gases generated when the fuse blows, deionizing of the expulsion discharge gases takes place in a deionizing muffler 138. The individual deionizing muffler 138 retains the expendable cap 136 and deflects and cools the hot discharge gases. This device may require the removal of the hot gas deionizing muffler 138 after each fuse operation for replacement of the fuse element (not visible in this view) and the expendable cap 136. It differs from U.S. Pat. Nos. 2,340,055, 3,575,683, and 3,868,617 in that the applied muffler controls and deionizes the gases at the top of the fuse. The lower end of the fuse is still vented freely such that double venting occurs. Fuse operation is substantially identical.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An electrical fault protective device for use in a circuit with a capacitor bank, comprising: a hollow bus tube electrically connected to the capacitor bank, said tube having a plurality of apertures therein; a plurality of expulsion fuses which blow at a predetermined fault level and produce expulsion products; and means for mechanically and electrically attaching the expulsion fuses to respective apertures of said hollow bus tube, such that at least a portion of the expulsion products may be directed into the hollow bus tube when the fuse blows.

2. The device of claim 1, wherein said hollow bus tube includes a planar wall.

3. The device of claim 1, wherein said hollow bus tube is rectilinear in cross-section.

4. The device of claim 1, wherein said hollow bus tube is curvilinear in cross-section.

5. The device of claim 1, wherein said attaching means is an internally threaded fuse-receiving cylinder having external means for attachment to said hollow bus tube.

6. The device of claim 1, wherein said attaching means is a fuse-receiving compression clamp attached to said hollow bus tube.

7. The device of claim 1, wherein said attaching means comprises mutually engaging threaded portions of said expulsion fuse and each of the hollow bus tube apertures.

8. The device of claim 1, wherein the attaching means further includes an annular flange mechanically and electrically joined to the hollow bus tube.

9. The device of claim 1, wherein said hollow bus tube includes means for exhausting expulsion products from said tube.

10. The device of claim 9, wherein said exhausting means is gas permeable.

11. The device of claim 9, wherein said exhausting means is a screen.

12. The device of claim 1, further including a plurality of expendable caps releasable into said hollow tube, each of said expendable caps covering an expulsion end of a respective expulsion fuse.

13. The device of claim 12, wherein said expendable caps are of metal.

14. The device of claim 12, including means associated with each respective fuse for releasably retaining a respective cap between the expulsion end of such expulsion fuse and the hollow bus tube.

15. The device of claim 1 wherein at least one of said fuses is a double-ended fuse capable of expulsion fuse expulsion products from one end of the fuse at the occurrence of a first fault level and from both ends of the fuse at the occurrence of a second fault level.

16. The device of claim 15 wherein said second fault level is higher than the first fault level.

17. An electrical fault protective device for use in a circuit with a capacitor bank, comprising: an electrically insulating hollow tube having a plurality of apertures therein; a plurality of expulsion fuses which blow at a predetermined fault level and produce expulsion products, each of said expulsion fuses having a longitudinal axis and at least one expulsion end from which expulsion products are expulsed axially; means for electrically interconnecting said expulsion fuses; and means for attaching the expulsion fuses to respective apertures of said insulating hollow tube, such that at least a portion of the axial expulsion discharge products of the fuses may be directed into the insulating hollow tube when the fuse blows.

18. The device of claim 17, wherein said tube is curvilinear in cross-section.

19. The device of claim 17, wherein said attaching means is an internally threaded fuse-receiving cylinder having external means for attachment to said hollow tube.

20. The device of claim 17, wherein said attaching means is a fuse-receiving compression clamp attached to said hollow tube.

21. The device of claim 17, wherein said attaching means comprises mutually engaging threaded portions of said expulsion fuse and each of the hollow tube apertures.

22. The device of claim 17, wherein the attaching means further includes an annular flange mechanically joined to the hollow tube.

23. The device of claim 17, wherein said hollow tube includes means for exhausting expulsion products from said tube.

24. The device of claim 23, wherein said exhausting means is gas permeable.

25. The device of claim 23, wherein said exhausting means is a removable screen.

26. The device of claim 15, further including a plurality of expendable caps releasable into said hollow tube, each of said expendable caps covering an expulsion end of a respective expulsion fuse.

27. The device of claim 17 wherein at least one of said fuses is a double-ended fuse capable of expulsing fuse expulsion products from one end of the fuse at the occurrence of a first fault level and from both ends of the fuse at the occurrence of a second fault level.

28. The device of claim 27 wherein said second fault level is higher than the first fault level.

29. An electrical fault protective device for use in a circuit with a capacitor bank, comprising: a hollow bus tube electrically connected to the capacitor bank, said tube having a plurality of apertures therein; a plurality of expulsion fuses which blow at a predetermined fault level and produce expulsion products, each of said expulsion fuses having a longitudinal axis and at least one expulsion end from which expulsion products are expulsed axially; and means for mechanically and electrically attaching the respective expulsion fuses to respective apertures of said hollow bus tube, such that expulsion products of the fuses may be directed into the hollow bus tube when the fuse blows.

30. The device of claim 29 wherein at least one of said fuses is a double-ended fuse capable of expulsing fuse expulsion products from one end of the fuse at the occurrence of a first fault level and from both ends of the fuse at the occurrence of a second fault level.

31. The device of claim 30 wherein said second fault level is higher than the first fault level.

32. An electrical fault protective device for use in a circuit, comprising: a hollow bus tube electrically connected in the circuit, said tube having a plurality of apertures therein; a plurality of expulsion fuses which blow at a predetermined fault level and produce expulsion products; and means for mechanically and electrically attaching the expulsion fuses to respective apertures of said hollow bus tube, such that at least a portion of the expulsion products may be directed into the hollow bus tube when the fuse blows.

33. The device of claim 32, wherein said hollow bus tube is rectilinear in cross-section.

34. The device of claim 32, wherein said hollow bus tube is curvilinear in cross-section.

35. The device of claim 32, wherein the attaching means further includes an annular flange mechanically and electrically joined to the hollow bus tube.

36. The device of claim 32, wherein said hollow bus tube includes means for exhausting expulsion products from said tube.

37. The device of claim 36, wherein said exhausting means is a gas permeable screen.

38. The device of claim 32, further including a plurality of expendable caps relative into said hollow tube, each of said expendable caps covering an expulsion end of a respective expulsion fuse.

39. The device of claim 32, wherein at least one of said fuses is a double-ended fuse capable of expulsing fuse expulsion products from one end of the fuse at the occurrence of a first fault level and from both ends of the fuse at the occurrence of a second fault level.

40. The device of claim 39, wherein said second fault level is higher than the first fault level.

41. An electrical fault protective device for use in a circuit, comprising:

an electrically insulating hollow tube having a plurality of apertures therein;

a plurality of expulsion fuses which blow at a predetermined fault level and produce expulsion products, each of said expulsion fuses having a longitudinal axis and at least one expulsion end from which expulsion products are expulsed axially;

means for electrically interconnecting said expulsion fuses; and means for attaching the expulsion fuses to respective apertures of said insulating hollow tube, such that at least a portion of the axial expulsion discharge products of the fuses may be directed into the insulating hollow tube when the fuse blows.

* * * * *

UNITED STATES PATENT AND TRADEMARK OFFICE

CERTIFICATE OF CORRECTION

PATENT NO. : 4,970,619

DATED : November 13, 1990

INVENTOR(S) : Edward F. VEVERKA ET AL

It is certified that error appears in the above-identified patent and that said Letters Patent is hereby corrected as shown below:

Column 7, line 30:

Claim 15, line 2, "expulsion" should read --expulsing--..

Column 8, line 5:

Claim 26, line 1, "claim 15" should read --claim 17--.

Signed and Sealed this

Thirty-first Day of March, 1992

*Attest:*

HARRY F. MANBECK, JR.

*Attesting Officer*

*Commissioner of Patents and Trademarks*